US005483129A

United States Patent [19]

Yamamoto

[11] Patent Number: 5,483,129

[45] Date of Patent: Jan. 9, 1996

[54] SYNCHROTRON RADIATION LIGHT-SOURCE APPARATUS AND METHOD OF MANUFACTURING SAME

[75] Inventor: Yuichi Yamamoto, Kobe, Japan

[73] Assignee: Mitsubishi Denki Kabushiki Kaisha, Tokyo, Japan

[21] Appl. No.: 96,994

[22] Filed: Jul. 27, 1993

[30] Foreign Application Priority Data

Jul. 28, 1992 [JP] Japan ..... 4-201062

[51] Int. Cl.[6] ..... H05H 7/04; H05H 13/04

[52] U.S. Cl. ..... 315/503; 29/607; 335/210; 250/396 R

[58] Field of Search ..... 328/235; 335/216

[56] References Cited

U.S. PATENT DOCUMENTS

| | | | |
|---|---|---|---|
| 2,824,969 | 2/1958 | Crowley | 250/49.5 |
| 3,263,136 | 7/1966 | Gordon | 335/213 |
| 3,303,426 | 2/1967 | Beth | 328/235 |
| 3,373,388 | 3/1968 | Meyerer | 335/210 |
| 3,379,911 | 4/1968 | Enge | 313/75 |
| 3,409,852 | 11/1968 | Uhlmann et al. | 335/216 |
| 3,659,236 | 4/1972 | Whitehead, Jr. | 335/210 |
| 3,671,895 | 6/1972 | Aucouturier | 335/212 |
| 4,680,565 | 7/1987 | Jahnke | 335/216 |
| 4,769,623 | 9/1988 | Marsing et al. | 335/216 |
| 4,783,634 | 11/1988 | Yamamoto et al. | 328/234 |
| 4,806,871 | 2/1989 | Ikegami et al. | 328/235 |
| 5,101,169 | 3/1992 | Gomei | 328/235 |
| 5,111,173 | 5/1992 | Matsuda et al. | 335/216 |
| 5,117,194 | 5/1992 | Nakanishi et al. | 328/233 |

FOREIGN PATENT DOCUMENTS

| | | |
|---|---|---|
| 943850 | 6/1956 | Germany . |
| 3704442 | 2/1987 | Germany . |
| 3928037 | 8/1989 | Germany . |
| 4000666 | 1/1990 | Germany . |

OTHER PUBLICATIONS

"1–2 GeV Synchrotron Radiation Source" Conceptual Design Report, Jul. 1986, Lawrence Berkeley Laboratory, Pub–5172 Rev., pp. 22–29, 62–65.

*Primary Examiner*—Donald J. Yusko
*Assistant Examiner*—Lawrence O. Richardson
*Attorney, Agent, or Firm*—Leydig, Voit & Mayer

[57] ABSTRACT

A synchrotron radiation light-source apparatus is provided in which the characteristics of synchrotron radiation generated by bending electromagnets can be made uniform, and emittance can be made smaller to increase brightness. The synchrotron radiation light-source apparatus for bending the traveling direction of an electron beam with bending electromagnets and for emitting synchrotron radiation includes deflecting electromagnets which cause a negative value (–dBy/dx) of a magnetic-field gradient gradually to increase after gradually decreasing in the traveling direction of the electron beam, that is, along the length of the bending electromagnets, so as to form a smooth recessing distribution, or to increase in a step-like manner after decreasing in a step-like manner.

2 Claims, 6 Drawing Sheets

$\ell_B$: LENGTH OF BENDING MAGNET $\ell_B$: LENGTH OF BENDING MAGNET $\ell_B$ : LENGTH OF BENDING MAGNET

ℓB : LENGTH OF BENDING MAGNET

SYNCHROTRON RADIATION LIGHT-SOURCE APPARATUS AND METHOD OF MANUFACTURING SAME

BACKGROUND OF THE INVENTION

1. Field of the Invention

The present invention relates to a synchrotron radiation light-source apparatus and a method of manufacturing the same.

2. Description of the Related Art

One known type of this apparatus is the synchrotron radiation light-source apparatus, shown in FIG. 8, which is described, for example, in the "1–2 GeV Synchrotron Radiation Source, Conceptual Design Report (July 1986)", page 23, published by Lawrence Berkeley Laboratory, University of California, Berkeley. In FIG. 8, reference numeral 1 denotes an orbiting trajectory of an electron beam; reference numeral 2 denotes bending electromagnets disposed at predetermined intervals with respect to the orbiting trajectory 1; reference numeral 3 denotes a focusing quadrapole electromagnet, disposed on the orbiting trajectory 1 before and after the bending electromagnets 2, for converging beams; and reference numeral 4 denotes a defocusing quadrapole electromagnet. FIG. 9 shows a betatron function within the bending electromagnets 2. FIG. 10 shows the coordinate system of the synchrotron radiation light-source apparatus. The horizontal axis S in FIG. 9 indicates the coordinates along the S axis in FIG. 10. Reference letter lB denotes the length of the bending electromagnet.

The operation of the synchrotron radiation light-source apparatus will now be explained. The orbit 1 of an electron beam is bent by the bending electromagnets 2; the electron beam is converged by the focusing quadrapole electromagnet 3 and the defocusing quadrapole electromagnet 4, while emitting synchrotron radiation (referred to as SR), and passes along and encircles a limited area along a closed orbit. The widths along the X and Y axes in the limited area along the closed orbit, i.e., beam sizes, are such that a value called emittance is multiplied by the square root of the betatron function values along the X and Y axes. Since the distribution of the betatron function along the closed orbit is determined by the deflection angle and the magnetic-field gradient of the bending electromagnet 2, by the magnetic-field gradient of the focusing quadrapole electromagnet 3, by the magnetic-field gradient of the defocusing quadrapole electromagnet 4, and by the locations of the electromagnets the value of the betatron function differs depending upon the position on the closed orbit. Also, emittance is determined uniquely for the SR light-source apparatus on the basis of the deflection angle and the magnetic-field gradient of the bending electromagnets 2; by the magnetic-field gradient of the focusing quadrapole electromagnet 3; by the magnetic-field gradient of the defocusing quadrapole electromagnet 4; by the positions at which the electromagnets are positioned; and by the beam energy. Regardless of the position on the closed orbit, the size of the emittance is the same. Emittance is obtained by multiplying a value obtained by integrating a function H(s) (shown in equation (1) below) in the bending electromagnets 2 by a value which is dependent on the beam energy.

$$H(s)=(\eta(s)^2+(\beta(s)\eta'(s)-\beta'(s)\eta(s)/2)^2)/2\pi\rho\beta(s) \quad (1)$$

where $\beta(s)$ is the betatron function along the X axis, $\rho$ is the deflection radius, and $\eta$ (s), called a dispersion function, is a function whose value, similarly to the betatron function, varies depending upon its position on the closed orbit. Although $\eta$ (s) does not vary much with respect to changes in the magnetic-field gradients of the bending electromagnets 2, the focusing quadrapole electromagnet 3 and the defocusing quadrapole electromagnet 4, $\beta$ (s) is a monotonically decreasing function with respect to a negative value of the magnetic-field gradient at position s. Therefore, in the conventional SR light-source apparatus, by making the bending electromagnets 2 have a fixed, negative magnetic-field gradient, the value of $\beta$ (s) is made small at the bending electromagnets 2 as shown in FIG. 9 so that emittance is made smaller.

However, in the conventional synchrotron radiation tight-source apparatus, since the bending electromagnets 2 are made to have only a fixed magnetic-field gradient, the betatron function has no fixed area along the S axis within bending electromagnets 2. Consequently, the beam size is not fixed. As a result, a problem arises, for example, in that the characteristics of synchrotron radiation generated from the bending electromagnets 2 differ depending upon the position at which they are extracted.

SUMMARY OF THE INVENTION

The present invention has been made to solve the above-described problem of the prior art.

It is an object of the present invention to provide a synchrotron radiation light-source apparatus in which the characteristics of synchrotron radiation generated from the bending electromagnets 2 is uniform, emittance is reduced to increase brightness, and that is easy to manufacture, and to provide a method of manufacturing the apparatus.

A synchrotron radiation light-source apparatus in accordance with one aspect of the present invention comprises bending electromagnets for making a negative value of the magnetic-field gradient of the bending electromagnet gradually increase after gradually decreasing along the traveling direction of the electron beam.

As an example, a bending electromagnet comprises a pair of coils facing each other with the orbit of the electron beam in between, each of the coils being formed as an air-core bending electromagnet twisted in opposite directions relative to the orbit of the electron beam so that the gap between the coils becomes greater toward the exterior of the orbit at the ends of the coils which serve as the entrance and exit for the electron beam.

As another embodiment, a bending electromagnet includes a pair of magnetic poles facing each other with the orbit of the electron beam in between, each of these magnetic poles being formed in such a way that the gap between the magnetic poles becomes gradually narrower in the interior of the orbit, and becomes gradually wider in the exterior of the orbit toward the ends of the coils which serve as the entrance and exit for the electron beam, wherein the gap between the magnetic poles is constant. As an example, each of the magnetic poles is formed in such a way that a plurality of semi-circular plates are stacked with the angle of the arc varing along the orbit of the electron beam.

The synchrotron radiation light-source apparatus in accordance with the second aspect of the present invention comprises a bending electromagnet for causing a negative value of the magnetic-field gradient to decrease in a step-like manner, and then increase in a step-like manner along the traveling direction of the electron beam. As an example, the bending electromagnet is formed by combining two or more types of iron cores.

According to a third aspect of the present invention, there is provided a method of manufacturing a synchrotron radiation light-source apparatus for generating synchrotron radiation by bending the orbit of an electron beam by means of a bending electromagnet, the method comprising the step of forming the bending electromagnet for causing a negative value of the magnetic-field gradient to gradually decrease and then gradually increase along the orbit of said electron beam by twisting a pair of facing coils with the orbit of said electron beam in between in opposite directions with the orbit of said electron beam as a reference, so that the gap between the coils becomes greater toward the exterior of said orbit at the ends of the coils which serve as the entrance and exit for the electron beam.

According to a fourth aspect of the present invention, there is provided a method of manufacturing a synchrotron radiation light-source apparatus for generating synchrotron radiation by bending the orbit of an electron beam by means of a bending electromagnet, the method comprising the step of forming the bending electromagnet for causing a negative value of a magnetic-field gradient to be distributed in a desired form along the orbit of the electron beam by using a pair of magnetic poles facing each other in which a plurality of semi-circular plates are stacked with the orbit of the electron beam in between with the angle of each arc along the orbit of said electron beam varying.

According to a fourth aspect of the present invention, there is provided a method of manufacturing a synchrotron radiation light-source apparatus for generating synchrotron radiation by bending the orbit of an electron beam by means of a bending electromagnet, the method comprising the step of forming a bending electromagnet for causing a negative value of the magnetic-field gradient to gradually increase after gradually decreasing along the traveling direction of the electron beam by combining two or more types of iron cores having magnetic poles with different shapes.

DESCRIPTION OF THE PREFERRED EMBODIMENTS

Embodiments of the present invention will be explained below with reference to the accompanying drawings.

First Embodiment

Figure 1:
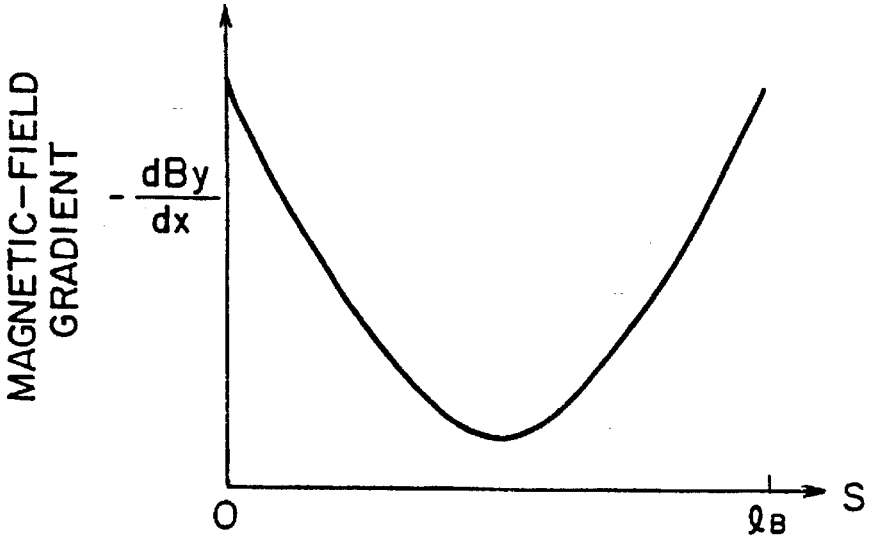
FIG. 1 is a graph illustrating the magnetic-field gradient of a bending electromagnet of a synchrotron radiation light-source apparatus in the traveling direction of an electron beam in accordance with a first embodiment of the present invention.
Figure 2:
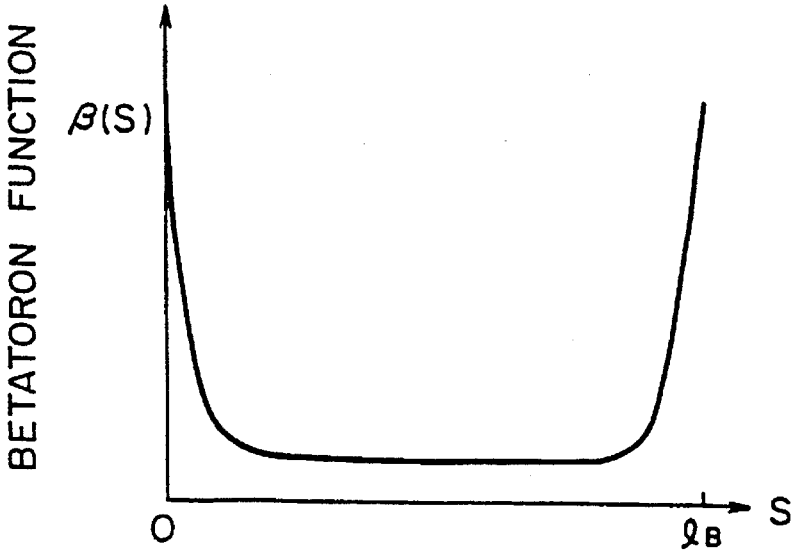
FIG. 2 is a graph illustrating the betatron function along the X axis within the bending electromagnet having the magnetic-field gradient shown in FIG. 1.

FIG. 1 is a graph illustrating the magnetic-field gradient of a bending electromagnet of a synchrotron radiation light-source apparatus in a beam travelling direction in accordance with a first embodiment of the present invention. FIG. 2 is a graph illustrating the betatron function along the X axis within the bending electromagnet having the magnetic-field gradient shown in FIG. 1. As shown in FIG. 1, the synchrotron radiation light-source apparatus comprises bending electromagnets which cause a negative value ($-dBy/dx$) of a magnetic-field gradient to gradually increase after gradually decreasing in the traveling direction of the electron beam, that is, along the length of the bending electromagnet, so as to form a smooth recessed distribution. Since, as described above, the betatron function $\beta$ (s) along the X axis at position s within the bending electromagnet is a monotonically decreasing function with respect to the negative value of the magnetic-field gradient at position s, as shown in FIG. 2, the betatron function $\beta$ (s) along the X axis at position s within the bending electromagnet becomes uniform and nearly fixed, small values in most areas as a result of the negative value of the magnetic-field gradient being distributed in a recessing manner. Consequently, the size of the electron beam within the bending electromagnet becomes constant, and therefore the characteristics of synchrotron radiation generated within the bending electromagnet can be made uniform. Also, since the betatron function value becomes a small value within the bending electromagnet, emittance can be reduced and brightness can be increased.

Second Embodiment

Figure 3A:
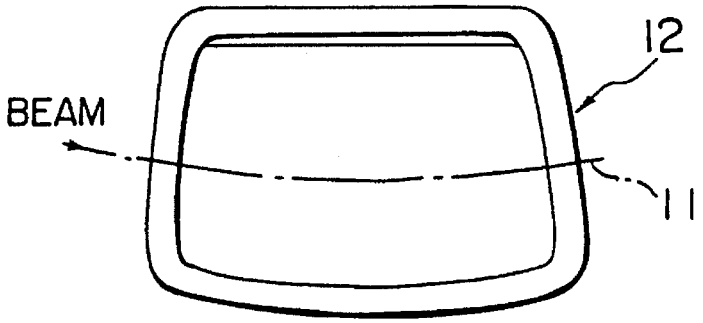
FIG. 3A is a plan view illustrating in more detail the bending electromagnet of the synchrotron radiation light-source apparatus in accordance with the first embodiment of the present invention.
Figure 3B:
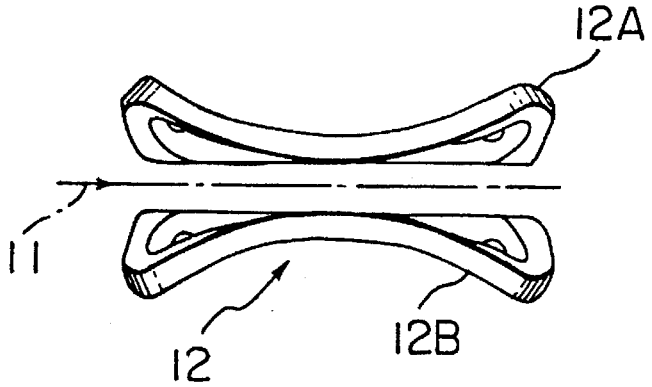
FIG. 3B is a side view thereof from a direction at right angles to the electron beam orbit.
Figure 3C:
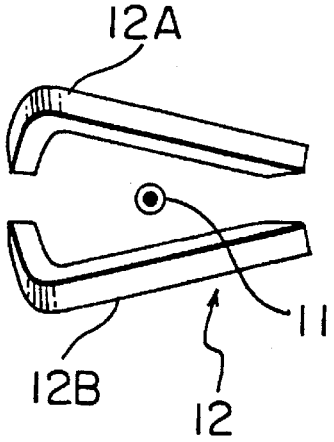
FIG. 3C is a side view thereof from a direction of the electron beam orbit.

FIGS. 3A, 3B and 3C illustrate in more detail the bending electromagnet of the synchrotron radiation light-source apparatus in accordance with the first embodiment of the present invention; FIG. 3A is a plan view thereof; FIG. 3B is a side view from a direction at right angles to the electron beam orbit; and FIG. 3C is a side view from a direction of the electron beam orbit. In these figures, a bending electromagnet 12 is formed of an air-core coil which is widely used in a superconducting bending electromagnet or the like. As shown in the figures, the bending electromagnet 12 comprises a pair of upper and lower coils 12A and 12B, these coils being twisted in opposite directions relative to the traveling direction of the electron beam. In other words, as shown in FIG. 3C from a side opposite to the traveling direction of the electron beam, the upper coil 12A is formed in such a way that the central portion thereof is twisted into a smallest amount in the clockwise direction with the orbiting trajectory 11 of the electron beam as an axis. In contrast, the lower coil 12B is formed in such a way that the central portion thereof is twisted into a smallest amount in the counterclockwise direction with the orbiting trajectory 11 of the electron beam as an axis. In other words, the coils 12A and 12B are formed in such a way that the gap between the coils becomes greater toward the exterior of the orbit 11, i.e., outside the area of the closed path of the electron beam, at the ends of the coils which serve as the entrance and exit for the electron beam. Therefore, in the bending electromagnet 12, since the entrance and exit for the electron beam of the upper coil 12A and the lower coil 12B for generating deflecting magnetic fields are twisted in opposite directions, the negative values of the magnetic-field gradient form a recessing distribution along the traveling direction of the electron beam, as shown in FIG. 1, and the betatron function along the X axis within the bending electromagnets 12 can be made uniform, small values, as shown in FIG. 2, making it possible to reduce emittance and increase brightness. In addition, in this embodiment, the upper and lower coils 12A and 12B can be manufactured easily and at a low cost by merely bending coils.

Third Embodiment

Figure 4A:
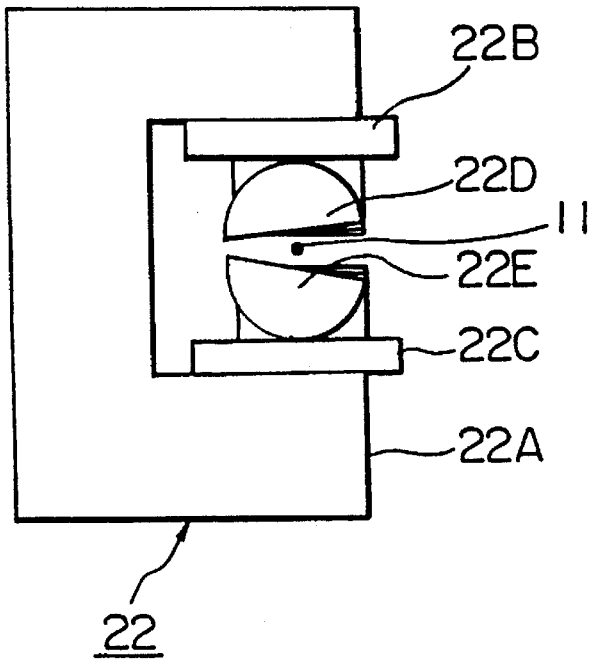
FIGS. 4A and 4B are respectively a side view from a direction of the electron beam orbit illustrating another embodiment of the bending electromagnet of the synchrotron radiation light-source apparatus in accordance with the present invention, and a side view from a direction at right angles to electron beam orbit.
Figure 4B:
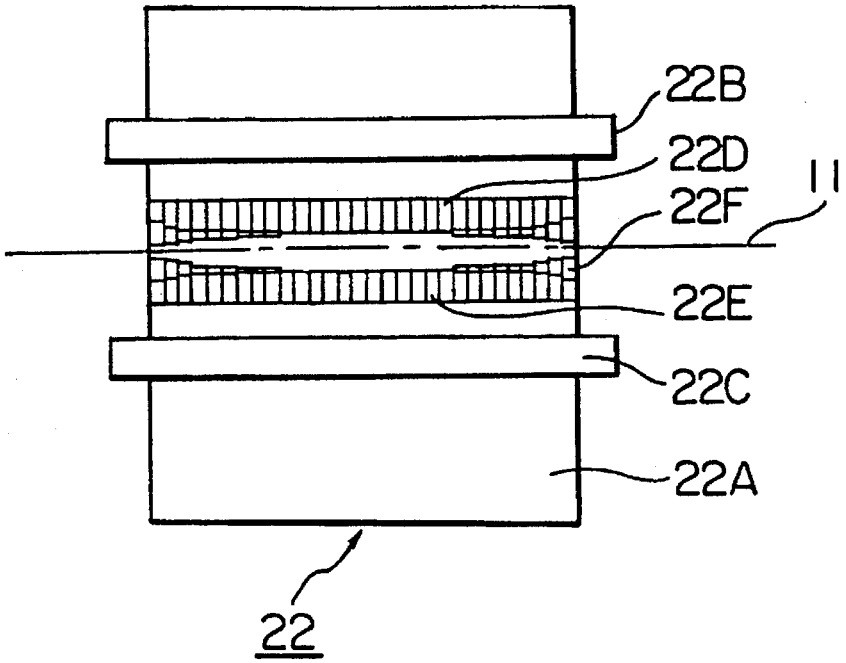
Figure 10:
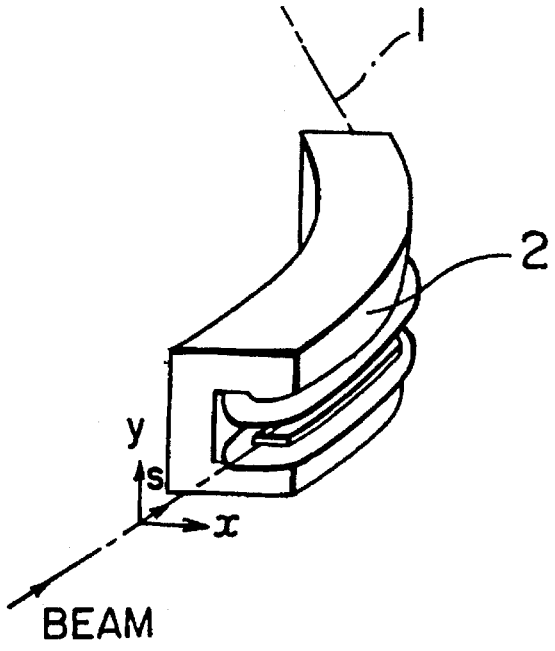
FIG. 10 is an illustration of a coordinate system of the synchrotron radiation light-source apparatus.

FIGS. 4A and 4B illustrate another embodiment of the bending electromagnet of the synchrotron radiation light-source apparatus in accordance with the present invention. FIG. 4A is a side view from a direction of the electron beam orbit; FIG. 4B is a side view from a direction at right angles to the electron beam orbit. Although this bending electromagnet is not shown clearly in the figures, similarly to the deflecting electromagnet shown in FIG. 10, it is as a whole curved along the electron beam orbit. As shown in FIGS. 4B and 4B, a bending electromagnet 22 of the synchrotron radiation light-source apparatus of this embodiment comprises a yoke 22A, coils 22B and 22C wound around portions facing the yoke 22A, and magnetic poles 22D and 22E mounted in the coils 22B and 22C, respectively. The magnetic poles 22D and 22E are formed to have top-bottom symmetry by stacking a plurality of thin semi-circular plates 22F face-to-face so that the faces of the plates form an arc. Furthermore, as regards the arcs of the semi-circular, thin plates, which form the magnetic poles 22D and 22E, as shown in FIGS. 4A and 4B, the gap between the magnetic poles becomes gradually narrower toward the interior of the orbit 11, i.e., inside the area of the closed path of the electron beam and becomes gradually wider in the exterior of the orbit 11, from the center of the bending electromagnet 22 toward the ends of the coils which serve as the entrance and exit for the electron beam, and the gap between the magnetic poles is constant. That is, the rotational angle of the stacked plates becomes gradually larger toward the ends of the coils. Therefore, in the bending electromagnet 22, the negative values of the magnetic-field gradient form a recessing distribution along the traveling direction of the electron beam in the section between the magnetic poles 22D and 22E for generating deflecting magnetic fields, as shown in FIG. 1. The betatron function along the X axis within the bending electromagnets 22 can be made uniform, with a small value, as shown in FIG. 2. Also, emittance can be reduced and brightness can be increased in the same manner as in the above-described embodiments. In addition, in this embodiment, the complex surface that the magnetic poles face can be realized by gradually varying the angle of the arcs of a plurality of semi-circular plates stacked along the beam orbit, and the apparatus can be manufactured easily and at a low cost. Also, it is possible to vary the changes in the angle of the arcs of a plurality of semi-circular stacked plates along the beam orbit as required. Although the magnetic poles 22D and 22E of the bending electromagnet 22 are formed of a plurality of thin stacked plates, they may be formed of thick plates or blocks.

Figure 5:
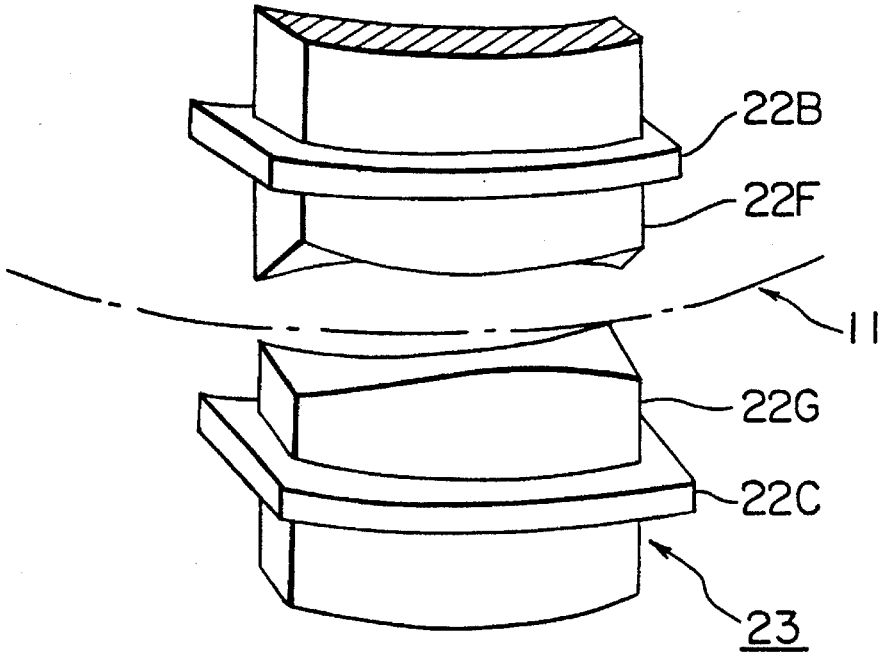
FIG. 5 is a perspective view illustrating still another embodiment of the bending electromagnet of the synchrotron radiation light-source apparatus in accordance with the present invention.

For example, a bending electromagnet 23 shown in FIG. 5, having magnetic poles 22F and 22G, may be used generally as a bending electromagnet. The surfaces of these magnetic poles 22F and 22G, which face each other, with the beam orbit 11 in between, become gradually narrower toward the interior of the orbit 11, and become gradually wider toward the exterior of the orbit 11, from the center of the bending electromagnet 23 toward the ends of the coils which serve as the entrance and exit for the electron beam, and the gap between the magnetic poles is constant in the orbit 11.

Fourth Embodiment

Figure 6:
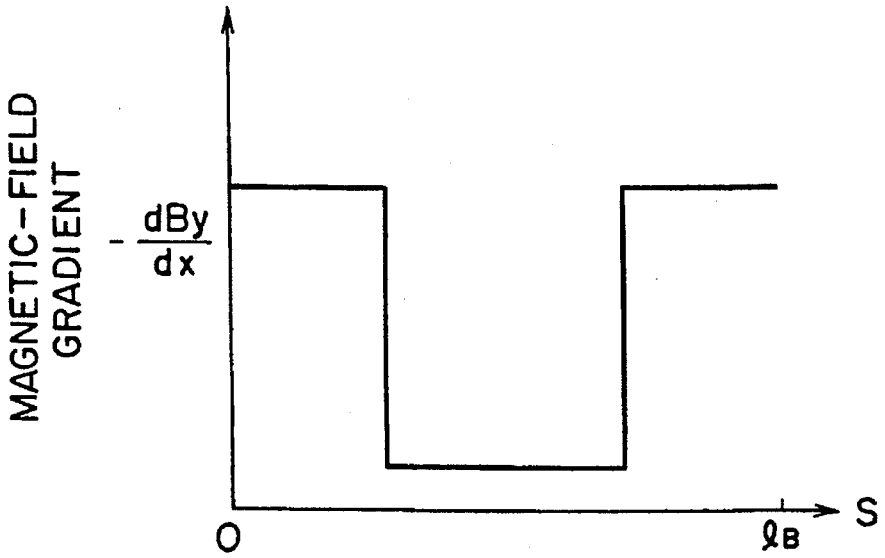
FIG. 6 is a graph illustrating the magnetic-field gradient of the bending electromagnet of a synchrotron radiation light-source apparatus in the traveling direction of an electron beam in accordance with a second embodiment of the present invention.
Figure 7:
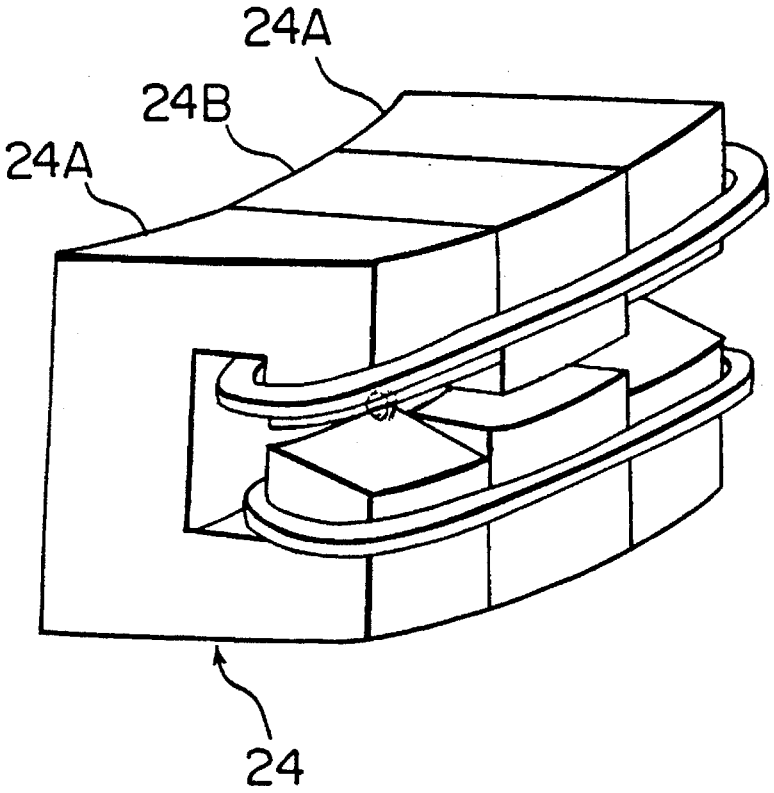
FIG. 7 is a perspective view illustrating in more detail the bending electromagnet of the synchrotron radiation light-source apparatus in accordance with the second embodiment of the present invention.
Figure 8:
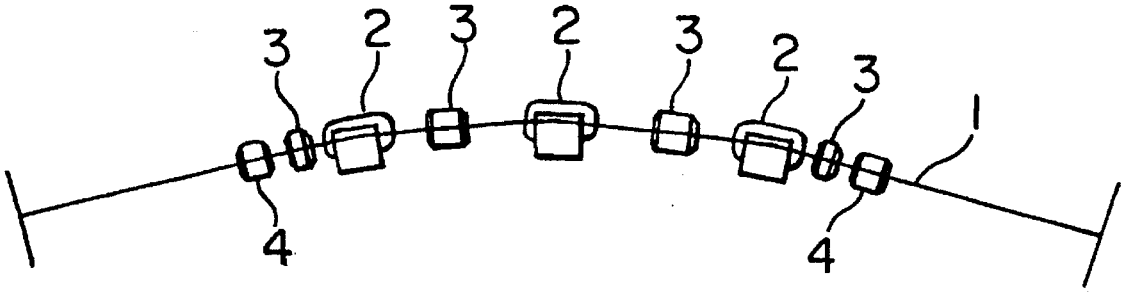
FIG. 8 is an illustration of one cycle of the synchrotron radiation light-source apparatus.
Figure 9:
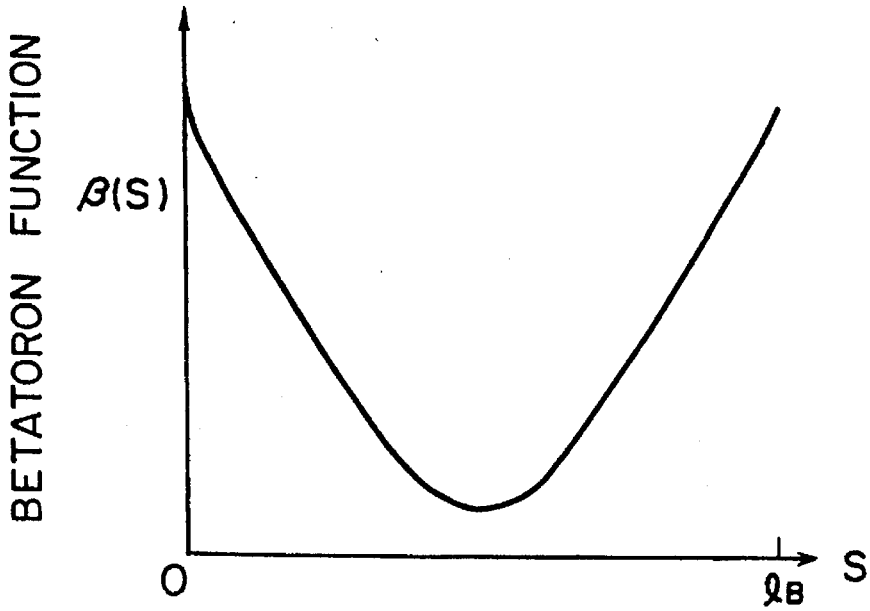
FIG. 9 is a graph illustrating the magnetic-field gradient of a bending electromagnet of a conventional synchrotron radiation light-source apparatus in the traveling direction of the electron beam.

FIG. 6 is a graph illustrating the magnetic-field gradient of the bending electromagnet of the synchrotron radiation light-source apparatus in the traveling direction of the electron beam in accordance with the second embodiment of the present invention. In this embodiment, as shown in FIG. 6, a bending electromagnet is provided which forms a square, recessing distribution in which the negative value (–dBy/dx) of the magnetic-field gradient decreases in a step-like manner along the traveling direction of the electron beam, and then increases in a step-like manner. Although the accuracy attainable by this embodiment is slightly lower than that of the first embodiment, advantages equivalent to those of the above-described embodiments can be realized. In addition, in this embodiment, since the deflecting magnetic gradient includes a square, recessing distribution, two types of iron cores 24A and 24B having magnetic poles with different shapes as a bending electromagnet 24 as shown in FIG. 7, may be combined to form the electronic bending electromagnet. Therefore, since a complex construction is unnecessary, this embodiment has an advantage, in particular, in that a bending electromagnet can be manufactured easily and at a low cost, though the uniformity of synchrotron radiation characteristics is inferior to that of the above-described embodiments.

Although two types of iron cores having magnetic poles with different shapes are combined to form a bending electromagnet shown in FIG. 7, three or more types of iron cores having magnetic poles with different shapes may be combined so that the magnetic-field gradient may be varied in two or more steps.

Also, the bending electromagnet in which the negative value of the magnetic-field gradient is varied in a step-like manner may be used in which the angle of the arcs of a plurality of semi-circular stacked plates of the bending electromagnet 22, shown in FIGS. 4A and 4B, is varied properly.

What is claimed is:

1. A synchrotron radiation light source apparatus for emitting synchrotron radiation by deflecting the orbit of an electron beam with a bending electro-magnet producing a negative magnetic field gradient gradually increasing after gradually decreasing along the orbit of the electron beam, said bending electromagnet including a pair of magnetic poles facing each other with the orbit of the electron beam passing through a gap between said magnetic poles, the gap between said magnetic poles becoming gradually narrower toward a direction pointing inside the orbit and gradually wider toward a direction pointing outside of the orbit at locations where the orbit enters and exits the gap between said magnetic poles, the gap being constant along the orbit between said magnetic poles and wherein each of said magnetic poles includes a plurality of semi-circular plates arranged in pairs of opposing plates with an angle formed between respective edges of each pair of said opposed plates, the angles between edges of pairs of said opposed plates varying along the orbit between said magnetic poles.

2. A method of manufacturing a synchrotron radiation light source apparatus for generating synchrotron radiation by deflecting the orbit of an electron beam with a bending electromagnet, said method comprising forming a bending electromagnet for producing a desired negative value magnetic field gradient distribution along the orbit of the electron beam by stacking a plurality of pairs of opposed semi-circular plates to form two magnetic poles on opposite sides of the orbit of the electron beam with an angle formed by edges of the opposed pairs of plates varying along the orbit of the electron beam.

* * * * *